US005303667A

United States Patent [19]

Zirkelbach et al.

[11] Patent Number: 5,303,667

[45] Date of Patent: Apr. 19, 1994

[54] BOAT CAMPER SYSTEM AND METHOD

[75] Inventors: Donald A. Zirkelbach, Sarasota; Dennis J. Parniske, Bradenton, both of Fla.

[73] Assignee: Aldon Industries, Inc., Bradenton, Fla.

[21] Appl. No.: 733,739

[22] Filed: Jul. 22, 1991

[51] Int. Cl.[5] ..... B63B 17/00

[52] U.S. Cl. ..... 114/361

[58] Field of Search ..... 114/361, 364, 201 R, 114/202, 203; 135/88

[56] References Cited

U.S. PATENT DOCUMENTS 3,955,228 5/1976 Gaschenko et al. ..... 114/361

5,009,184 4/1991 Voldrich ..... 114/361

*Primary Examiner*—Sherman Basinger

*Attorney, Agent, or Firm*—Howard & Howard

[57] ABSTRACT

A camper system and method for extending the length of a boat cover. The camper system includes a link assembly that pivotally mounts to the hull of the boat and extends upward to support a boat camper. A first link is mounted to the boat hull aft of the link assembly. The first link extends away from the boat hull and couples to the link assembly. A second link also extending aft is pivotally coupled to the link assembly to support a camper extension connected to the camper. A strut is pivotally coupled between the second link and the first link to hold the second link in position. The second link slides along the first link to collapse the camper extension.

13 Claims, 4 Drawing Sheets

BOAT CAMPER SYSTEM AND METHOD

BACKGROUND OF THE INVENTION

1. Field of the Invention

This invention relates to a camper system for use on a boat and a method for using the same. More particularly, this invention relates to an apparatus for extending existing boat covers that easily opens and closes.

Many boats have a camper top to protect boaters from in the boat from sun and the rain. Standard camper configurations cover the cockpit to provide protection for the boat driver. These campers can also extend from the bow of the boat to the stern of the boat to cover the boat's deck to protect the boat's other occupants as well. Many of these campers fold up when the operator desires to experience open air or wants to sunbathe. Some examples of these boat campers and canopies are disclosed in U.S. Pat. No. 2,513,764, U.S. Pat. No. 2,8I7,345, U.S. Pat. No. 2,823,684, U.S. Pat. No. 2,833,296, U.S. Pat. No. 3,285,259 and U.S. Pat. No. 3,371,672.

However, a problem with many of the aforementioned campers is that they require ties or struts that extend off the rear of the camper to hold the camper in place as the boat moves. These ties or struts may cause an obstruction when fishing off of the deck. Further, it is desirable to partially remove the portion of the camper that protects the deck while maintaining protection from the sun in the cockpit. One problem with many of the prior campers is that they must be folded up completely and do not allow for partial covering.

SUMMARY OF THE INVENTION

An object of this invention is to provide an improved camper system and method;

Another object of the invention is to construct an extension to existing camper systems that may be added on to protect a boaters on deck from the sun while not obstructing the aft of the boat for fishing;

It is further an object of this invention to fabricate a camper system that may be partially collapsed to expose the deck of the boat to sunlight while the main part of the camper remains standing to protect other boating occupants;

It is an additional object of the invention to provide a method of easily covering the entire cockpit of the boat while allowing the cover to be easily collapsed and removed out of the way of the occupants;

It is another object of the invention to construct a camper system that is easy to fold up while not obstructing the view off the aft of the boat when the camper is completely extended.

These and other objects are provided with a camper system comprising a link assembly pivotally mounted to a boat hull. The camper system also includes a first link having a first end and a second end. The first link being pivotally mounted to the boat hull a predetermined distance aft from the link assembly at the first end and pivotally coupled to the link assembly at the second end. The camper system has a second link pivotally to the first link between the first and second end and a strut pivotally coupled at one end to the second link and at another end to the first link between the second link connection and the second end. Thus, the strut is able to slide along the second link to collapse the boat camping system. Further, the strut provides support for the camper so as to not require a pull down strap off the rear of the camper which obstructs the aft of the boat.

In a preferred embodiment. the invention is practiced with a method of extending a main link assembly having a main link mounted to the hull of the boat and extending around the boat. The main link is supported by a first link at one end that is slidably coupled to the main link. At the other end, the first link is mounted t the boat deck aft of the main link. The main link and the main link assembly support a main cover which extends around a portion of the boat hull. A first and second slide is placed over the first link. A strut is then pivotally coupled to the first slide and a second link is pivotally coupled to the second side. An extension cover is attached onto the second link and mates with the main cover. The first slide is separated from the second slide on the main link after attaching the extension cover to extend the extension cover over the boat deck. The extension cover may then extend over the boat deck without obstructing the aft of the boat. It may be preferable that thumbscrews be provided with the first and second slide, and the first and second slide be attached to the first link to hold the second link in place when the extension cover is extended. It may also be preferable that the first slide and the second slide be drawn together on the first link to collapse the extension cover on the boat deck without affecting the main link assembly.

DESCRIPTION OF THE PREFERRED EMBODIMENTS

Figure 1:
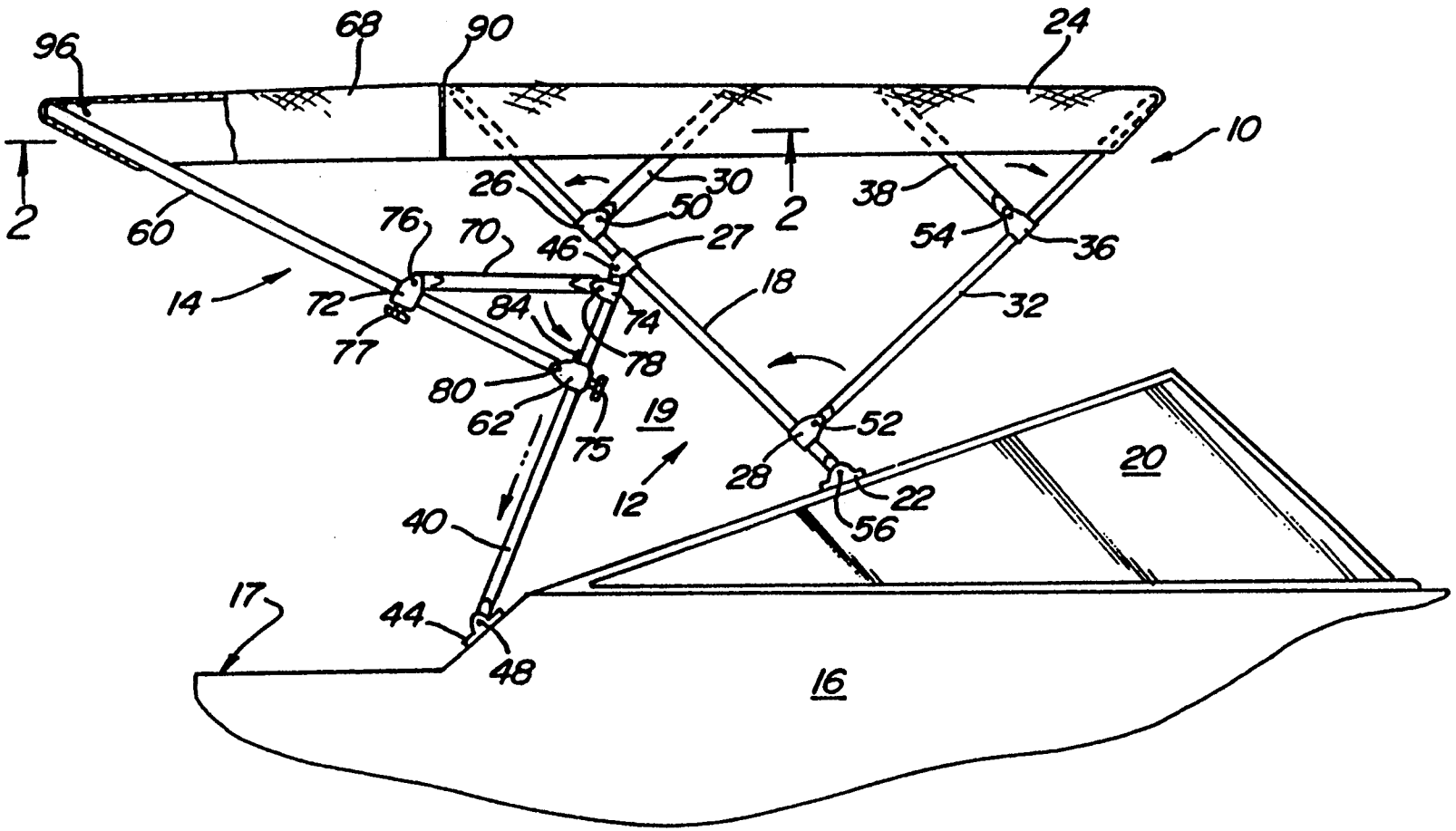
FIG. 1 is a side view of a camper system in a fully extended position illustrating the invention.

Referring to FIGS. 1, 3–4, and 6 there is shown a camper system designated generally by number 10 having a main link assembly 12 coupled to camper system extension assembly 14 and mounted to boat hull 16. Extending link assembly 12 and extension assembly 14 are covers 24 and 68, respectively constructed with known boat cover material such as canvas, nylon, etc.

Figure 6:
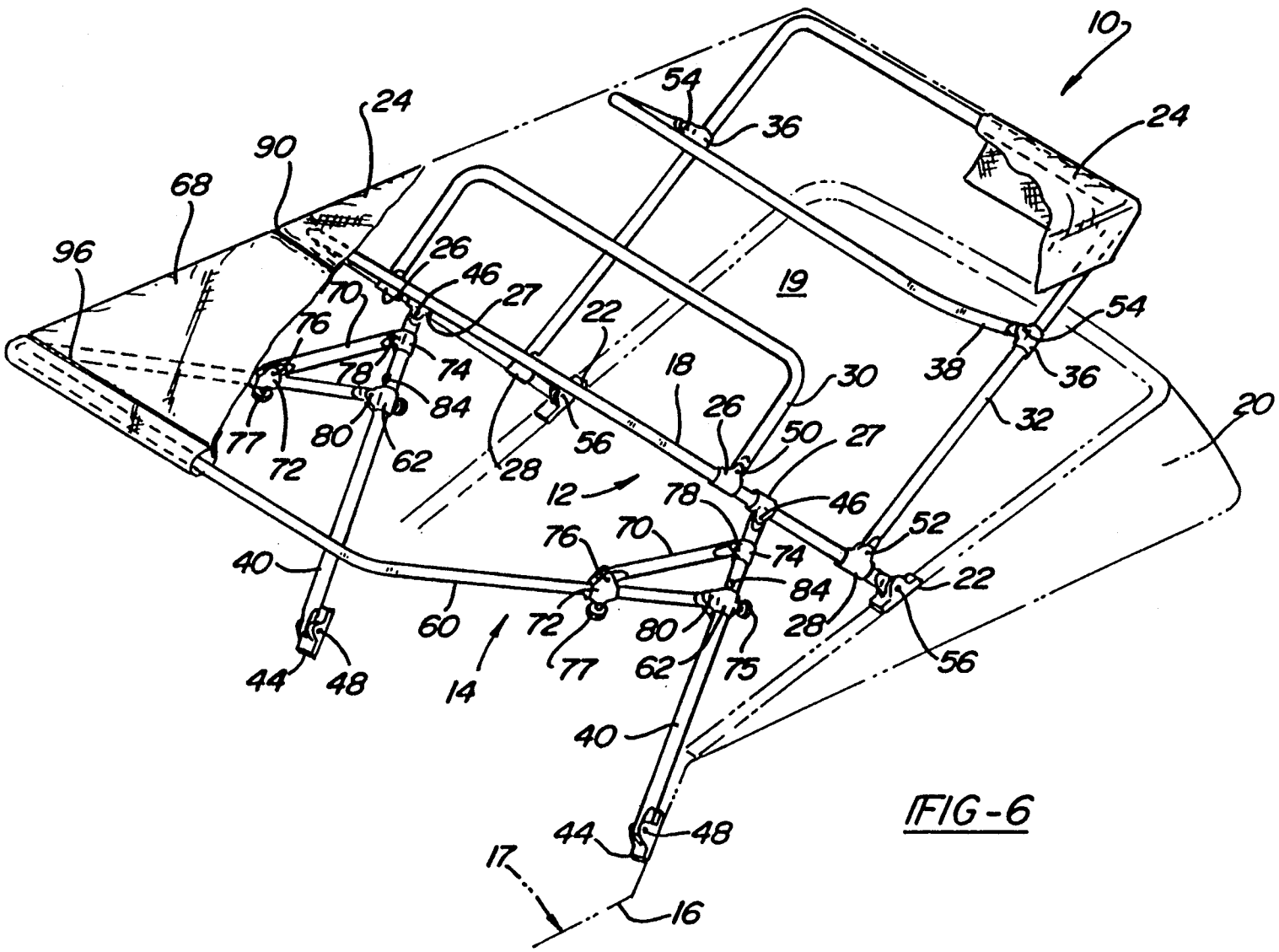
FIG. 6 is a perspective view of the camper system of the present invention.

Link assembly 12 includes link 18 which extends around cockpit 19 and is mounted at one end to windshield 20 on the starboard side of boat hull 16 with brace 22 and is mounted on the port side of boat hull 16 with a similar brace, see FIG. 6. Link 18 supports main cover 24 at its top. Also extending to both sides of hull 16 and slidably coupled on the boat's starboard side to link 18 with slides 26 and 28 respectively, are support link 30 and link 32 which extend perpendicularly away from link 18 to support cover 24. Links are attached to the port side of link 18 with similar slides (not shown). Slidably coupled to link 32 with slide 36 is support link 38. Support link 38 extends perpendicularly away from link 32 to support cover 24.

First link 40 is pivotally coupled with slide 27 to link 18 at a first end, and is mounted on the starboard side of boat hull 16 with brace 44 at link's 40 second end. A corresponding first link is mounted on the port side of hull 16 and couples to link 18 in a manner similar to first link 40. It is preferable that brace 44 be positioned adjacent deck 17. First link 40 is connected to slide 2 with pivot 46 and coupled to brace 44 with pivot 48.

Support link 30 and link 32 are coupled to slides 26 and 28 with pivots 50 and 52, respectively. Support link 38 is connected to slide 36 with pivot 54, and link 18 is coupled to brace 22 with pivot 56.

Camper system extension assembly 14 includes a second link 60 extending from one side of the boat hull to the other and coupled on the starboard side of boat hull 16 with adjustable slide 62 to first link 40. Second link 60, when cover 68 is extended (FIG. 1 and 6), extends perpendicularly away from first link 40 upward and mates with extension cover 68.

Camper system extension assembly 14 also includes a pair of struts. Strut 70 is disposed on the starboard side of boat hull 16 and is coupled at one end with adjustable slide 72 to second link 60 and is coupled at its other end with slide 74 to first link 40 between slide 27 and slide 62. Strut 70 is connected to slides 72 and 74 with pivots 76 and 78 respectively. Second link 60 is connected to slide 62 with pivot 80. The strut on the port side of extension assembly 14 connects in a similar manner.

Figure 3:
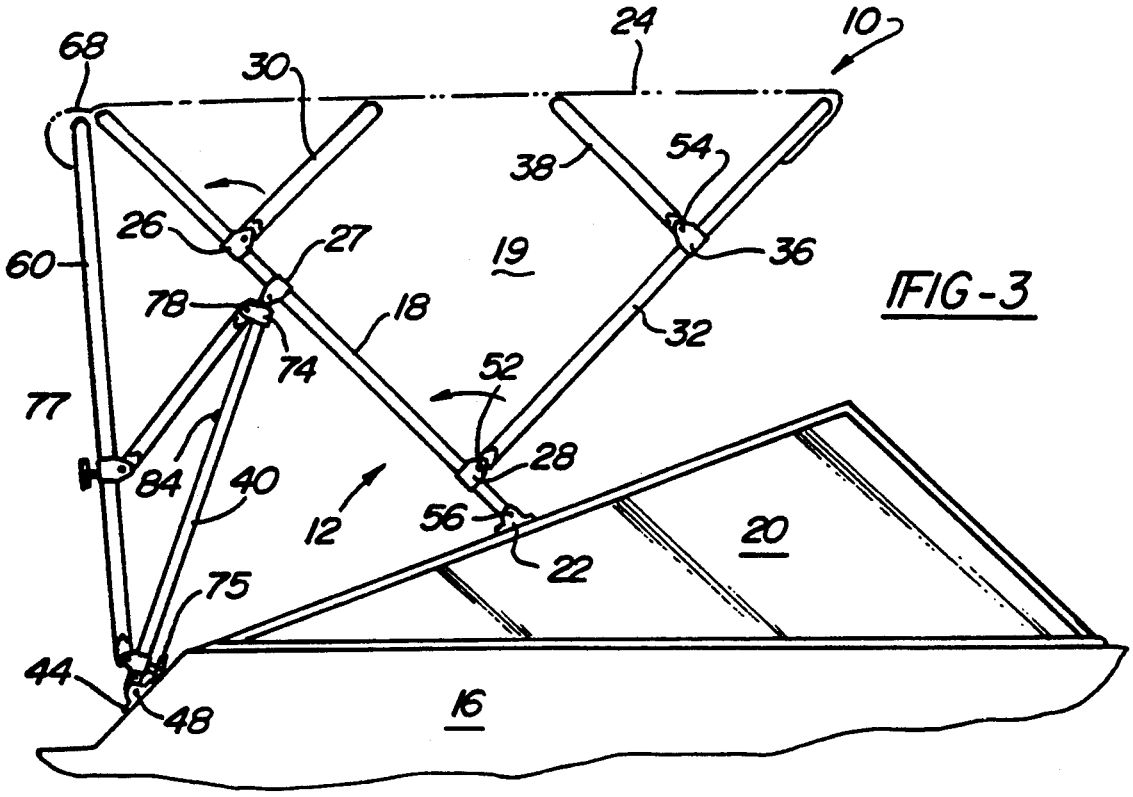
FIG. 3 is a side view of the camper system shown in FIG. 1 with a camper system extension assembly in a collapsed position.
Figure 4:
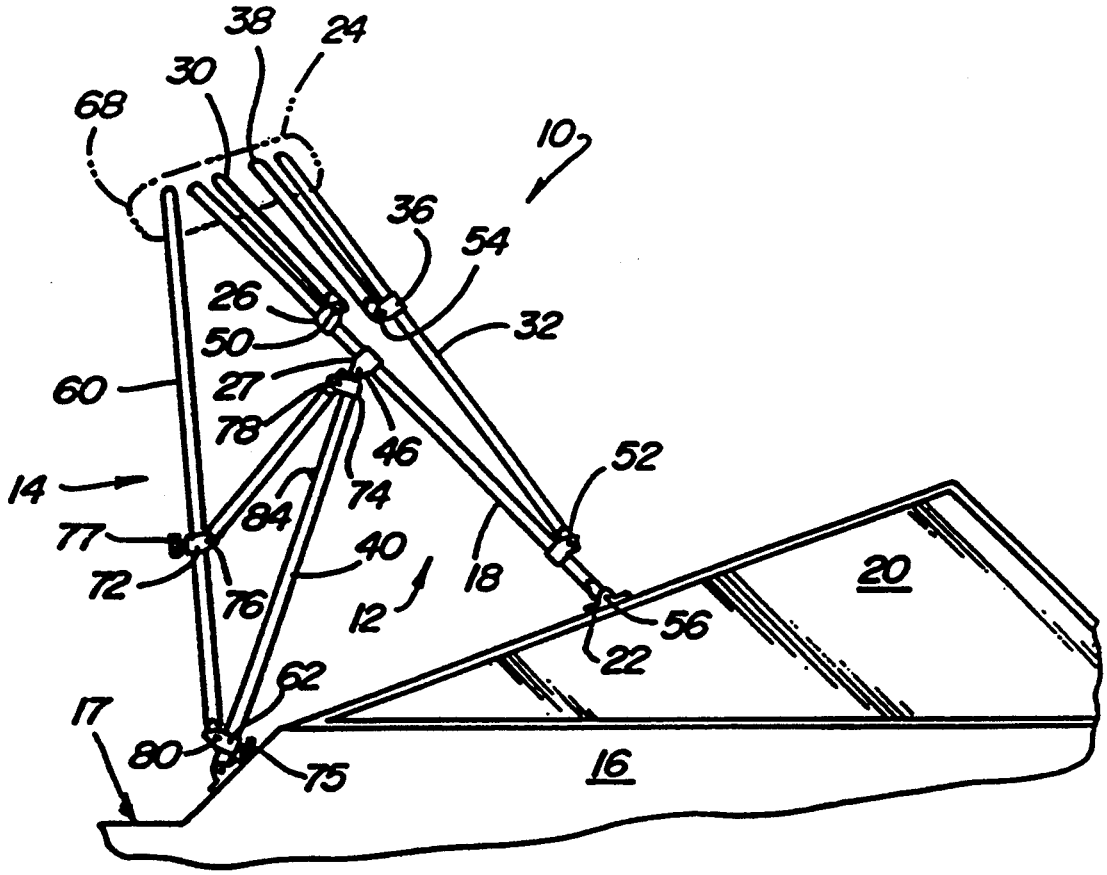
FIG. 4 is a side view of the camper system shown in FIG. 1 in a fully collapsed position.

Adjustable slide 62 moves along first link 40 to collapse camper system extension assembly 14 (see FIGS. 3 and 4). A stop rivet 84 is embedded into first link 40 between slide 62 and slide 74 to limit the upward movement of slide 62 on first link 40 thus limiting the extension of second link 60. Adjustable slides 72 and 62 have thumbscrews 75 and 77 respectively, which rotate into the adjustable slides to lock the position of camper system extension assembly 14. Thumbscrews 75 and 77 help maintain covers 24 and 68 in an extended or collapsed position.

Figure 2:
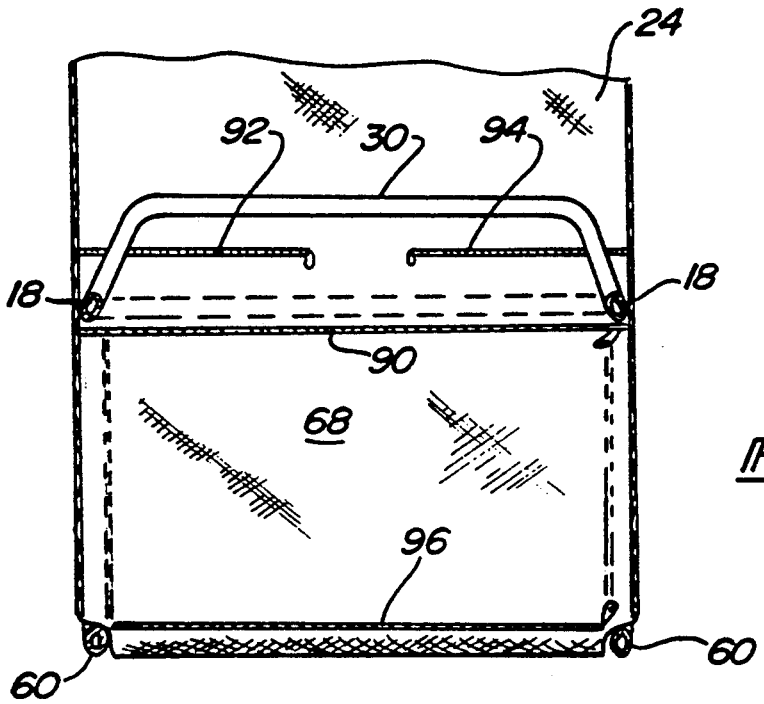
FIG. 2 is a bottom view of the cover cut along line 2—2 of FIG. 1.

Referring to FIG. 2, there is shown main cover 24 coupled to extension cover 68 using the zipper 90. Main cover 24 is supported by link 18 and support link 30. Extension cover 68 is supported with second link 60 extending therethrough. Extension cover 68 may be easily removed from main cover 24 and stored away to uncover deck 17. Disposed on main cover are zippers 92 and 94 which allow cover to be removed from link assembly 12. A zipper 96 is disposed on the rear of extension cover 68 so that extension cover 68 may be removed from second link 60.

Although camper system 10 is shown connected to a windshield 20, brace 22 and deck 17 with brace 44, this camper system may be mounted anywhere on the boat hull. However, it is preferable that brace 44 be located a predetermined distance aft from brace 22.

Referring to FIG. 3, there is shown camper system extension assembly 14 in a collapsed position. To orient extension assembly 14 in this position, thumbscrew 75 is loosened on adjustable slide 62, and then slide 62 to move down toward brace 44 on first link 40. Accordingly, the end of second link 60 that contacts cover 68 moves toward link 18 to collapse extension cover 68. Once collapsed, extension cover 68 may be easily removed or left in place in a collapsed position between link 18 and second link 60. Adjustable slide 62 is moved forward and backward on first link 40 to collapse and extend extension cover over boat deck 17.

Referring to FIG. 4, link assembly 12 may be collapsed upon camper system 10 by pivoting support links 30 and 38 into position parallel to links 18 and 32, respectively. Link 32 is then pivoted to be substantially parallel to link 18 to collapse main cover 24. Camper system extension assembly 14 is collapsed using the method described in FIG. 3.

Figure 5:
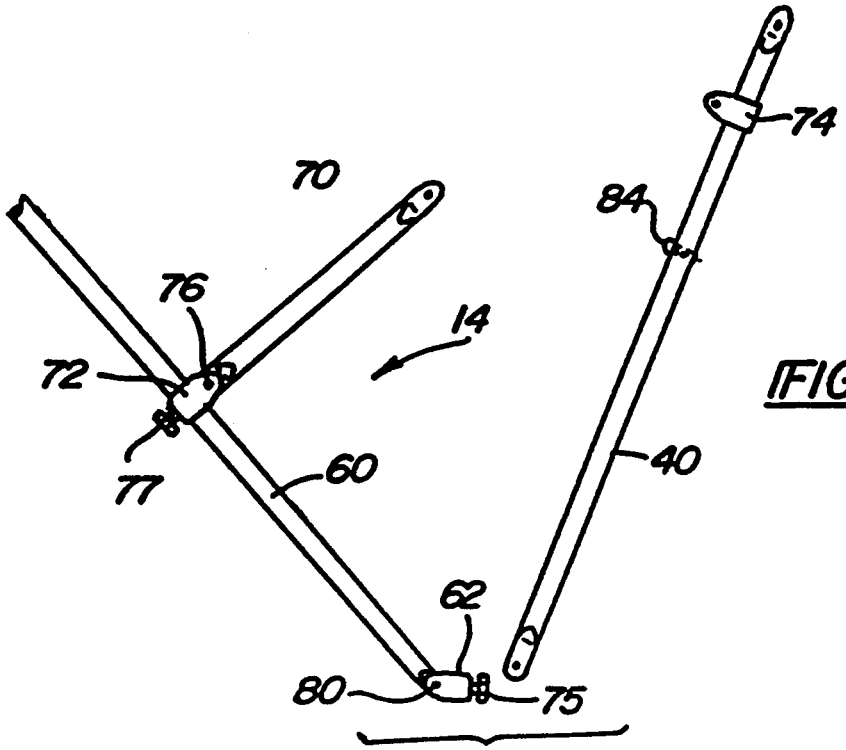
FIG. 5 is a partial side view of the extension assembly of the camper system illustrating its connection to a main link assembly.

Referring to FIG. 5, there is shown a diagram illustrating the simplicity of attaching extension assembly 14 to link assembly 12. First link 40 of link assembly 12 is attached to first link 40 adjacent one end, and slide 62 is then extended over first link 40. First link 40 is then connected to brace 44 with pivot 48, and pivot 78 is fed through slide 74 to connect strut 70 to first link 40. Adjustable slides 72 and 62 are loosened or tightened to place camper system extension assembly 14 in the desired position. Accordingly, camper system extension assembly 14 may be easily combined with an existing link assembly 12 without having to attach the new extension assembly 14 to the boat hull 16. It may be preferable, however, that a strap be used to secure extension cover 68 to the aft of boat hull 16 to provide additional support.

This concludes the description of the preferred embodiments. A reading by those skilled in the art will bring to mind various changes without departing from the spirit and scope of the invention. It is intended, however, that the invention only be limited by the following appended claims.

What is claimed is:

1. A camper system comprising:

a link assembly pivotally mounted to a boat hull;

a first link having a first end and a second end, said first end being pivotally mounted to the boat hull a predetermined distance aft of said link assembly and said second end pivotally coupled to said link assembly;

a second link pivotally coupled to said first link between said first and second end; and a strut having opposed ends with one of said opposed ends being pivotally coupled to said second link and said other opposed end being coupled to said first link between said first end and said second end.

2. The camper system as recited in claim 1 wherein said strut is coupled to said second link with an adjustable fitting that slides along said second link to collapse said camper system.

3. The camper system as recited in claim 2 wherein said second link is pivotally coupled to said first link with an adjustable fitting that slides along said first link.

4. The camper system as recited in claim further comprising a main cover extending over said link assembly to cover the boat hull;

an extension cover extending from said main cover and over said second link; and means attached to said main cover and said extension cover for mating said extension cover with said main cover, said mating means extending substantially parallel to a portion of said second link and being disposed between link assembly and said second link.

5. A method of extending a main link assembly having a main link mounted to a hull of a boat and extending around the boat, the main link being supported by a first link at one end slidably coupled to the main link and at the other end mounted to the boat deck aft of the main link, the main link and main link assembly supporting a main cover which extends over a portion of the boat hull; the method comprising the steps of:

placing a first and second slide over the first link;

pivotally coupling a strut to said first slide and a second link to said second slide;

pivotally coupling the strut to the second link;

attaching an extension cover onto said second link;

mating said extension cover with said main cover; and separating said first slide from said second slide on said first link after attaching said extension cover to extend the extension cover over the boat deck.

6. The method as cited in claim 5 further comprising the steps of providing a thumbscrew on said second slide and attaching said second slide to said first link to hold said second link in place when the extension cover is extended.

7. The method as recited in claim 5 further comprising the step of drawing said first and second slides together on said first link to collapse the extension cover on the boat deck.

8. The method as recited in claim 7 further comprising the step of removing the extension cover from the main cover and the second link after drawing the first and second slide together.

9. A camper system mounted to a hull on a boat, having a port side and starboard side, the system comprising:

a main link for supporting a boat cover including:

(a) said main link extending over the boat and pivotally mounted the hull of the boat on the port side and the starboard side;

(b) at least one support link pivotally mounted to said main link and extending away from said boat hull, (c) a main cover supported by the main link and said support link;

(d) a pair of first links pivotally mounted to said boat hull aft a predetermined distance away from said main link, and pivotally coupled to said main link with a slide; one of said first links being mounted on the port side and the other being mounted on the starboard side;

an extension assembly for extending the boat cover over a boat deck, the extension assembly including:

(a) a second link extending over the boat deck and pivotally coupled with adjustable slide to said first link on the starboard side of the boat and pivotally coupled with another adjustable slide on the port side of the boat;

(b) a pair of struts, one of said struts disposed on said port side and the other on said starboard side, each strut being pivotally coupled at one end to said second link and pivotally coupled at the other end to said first link between the adjustable slide and the slide; and (c) said adjustable slides moving along said first link to collapse and extend the boat cover over the boat deck with the second link.

10. The camper system as recited in claim 9 further comprising:

a boat cover having a main cover that extends over the main link assembly and is supported by the main link and the support link;

a extension cover being supported by the second link and extending to the main cover;

first zipper means for mating the main cover with the extension cover; and second zipper means for removably mating said extension cover with the second link.

11. The camper system as recited in claim 9 further comprising a thumbscrew means screwably mating with the adjustable slide for maintaining the cover in an extended position or a collapsed position.

12. The camper system as recited in claim 9 further comprising a rivet means coupled to said first link for restricting the movement of the adjustable slide to limit the extension of the boat cover with the second link.

13. The camper system as recited in claim 1, wherein said second link is slideably coupled to said first link between said first and second end; and said strut is slidebly coupled to said second link and said other opposed end is slidebly coupled to said first link between said first end and said second end.

* * * * *